US005335889A

United States Patent [19]

Hopkins et al.

[11] Patent Number: 5,335,889

[45] Date of Patent: Aug. 9, 1994

[54] BRACKET MOUNTABLE TO AN UPRIGHT SUPPORT FOR HOLDING A SIGN

[75] Inventors: Thomas M. Hopkins, Martinsville; Larry W. Hall, Bloomington, both of Ind.

[73] Assignee: Hall Signs, Inc., Bloomington, Ind.

[21] Appl. No.: 17,625

[22] Filed: Feb. 12, 1993

[51] Int. Cl.[5] ..... A47B 96/00

[52] U.S. Cl. ..... 248/231; 40/607; 40/617; 248/219.4

[58] Field of Search ..... 248/231, 230, 219.4, 248/219.3, 218.4, 309.1; 40/607, 611, 617

[56] References Cited

U.S. PATENT DOCUMENTS

| | | | |
|---|---|---|---|
| D. 233,017 | 10/1974 | Hall | D8/373 |
| 965,566 | 7/1910 | Cooley | 40/607 |
| 1,297,021 | 3/1919 | Shodron | 248/231 |
| 1,697,025 | 1/1929 | Searle | 40/607 |
| 1,845,967 | 2/1932 | Fox | 40/607 |
| 3,370,369 | 2/1968 | Look | 248/231 X |
| 3,612,460 | 10/1971 | Smith | 248/231 |
| 4,706,400 | 11/1987 | Howard | 40/617 |
| 4,730,803 | 3/1988 | Hillstrom | 248/219.4 X |
| 4,880,195 | 11/1989 | Lepley | 248/219.3 |

*Primary Examiner*—J. Franklin Foss
*Attorney, Agent, or Firm*—James D. Hall

[57] ABSTRACT

A bracket serving as a sign support by providing a leg and a foot with a multiple of retainers carried by the leg and foot for holding the sign in a vertical orientation.

3 Claims, 1 Drawing Sheet

BRACKET MOUNTABLE TO AN UPRIGHT SUPPORT FOR HOLDING A SIGN

FIELD OF THE INVENTION

This invention relates to a bracket mountable as a sign support having an improved multiple-point attachment system for securing and supporting the sign.

SUMMARY OF THE INVENTION

Signs have become commonplace and necessary items in our lives. The orientation of a sign may be commercial or municipal in nature. It may be informational or directional. Regardless of its format or content, signs direct us and enable us to successfully get from one place to another.

The method of displaying signs for optimum observation is diverse. The sign display of this invention features an L-shaped bracket. The L-shaped bracket accommodates the sign by way of a unique multiple-point attachment system into which the sign is fitted, securely fastened and retained. The bracket is mountable to an upright independent support such as in the form of a post or a pole. Similar sign brackets, such as shown in U.S. Pat. No. Des. 233,017, lacked in some respects adequate peripheral engagement elements to prevent sign flexure when held by the bracket during windy conditions.

It is an object of this invention to provide a novel bracket for supporting a sign.

Another object of this invention is to provide for a sign support with a multiple-point attachment system.

Another object of this invention is to provide for a sign supporting bracket with improved securability and stability.

Other objects of this invention will become apparent upon a reading of the following description taken with the accompanying drawings.

BRIEF DESCRIPTION OF THE DRAWINGS

A preferred embodiment of the invention has been depicted for illustrative purposes only wherein.

DESCRIPTION OF THE PREFERRED EMBODIMENT

The preferred embodiment herein described is not intended to be exhaustive or to limit the invention to the precise form disclosed. It is chosen and described to explain the principles of the invention and its application and practical use to enable others skilled in the art to utilize its teachings.

Figure 1:
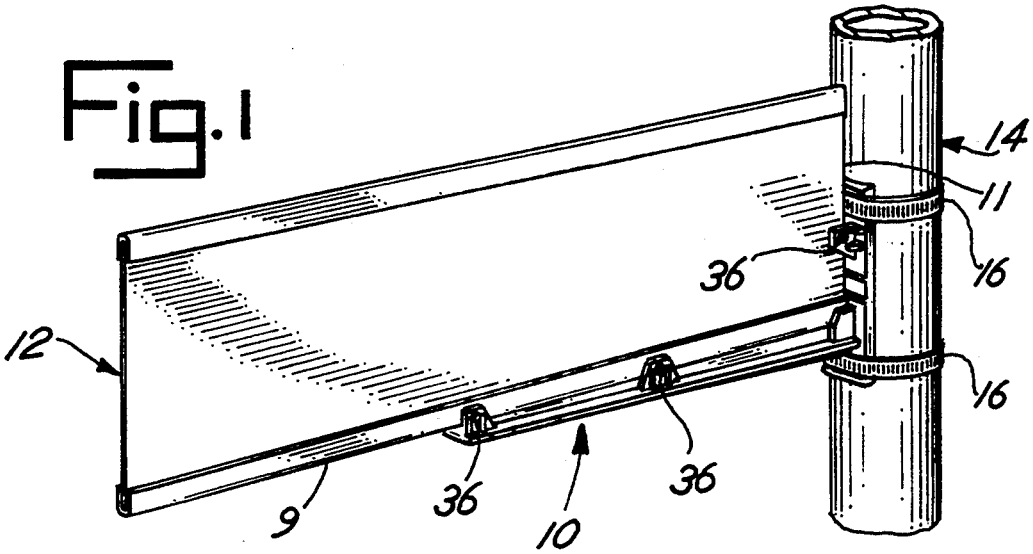
FIG. 1 is a perspective view of the bracket supporting a sign with the bracket mounted to an upright pole.

With reference to FIG. 1 of the drawings, reference numeral 10 generally refers to the bracket of this invention which is used as a support from which to secure and display a sign 12. Bracket 10 has four protruding retainer elements 18, 19, 22, and 24 for supporting sign 12 and is adapted for connection to an upright support, herein illustrated as a pole 14. Fastener bands 16 are shown utilized to connect bracket 10 to pole 14.

Figure 2:
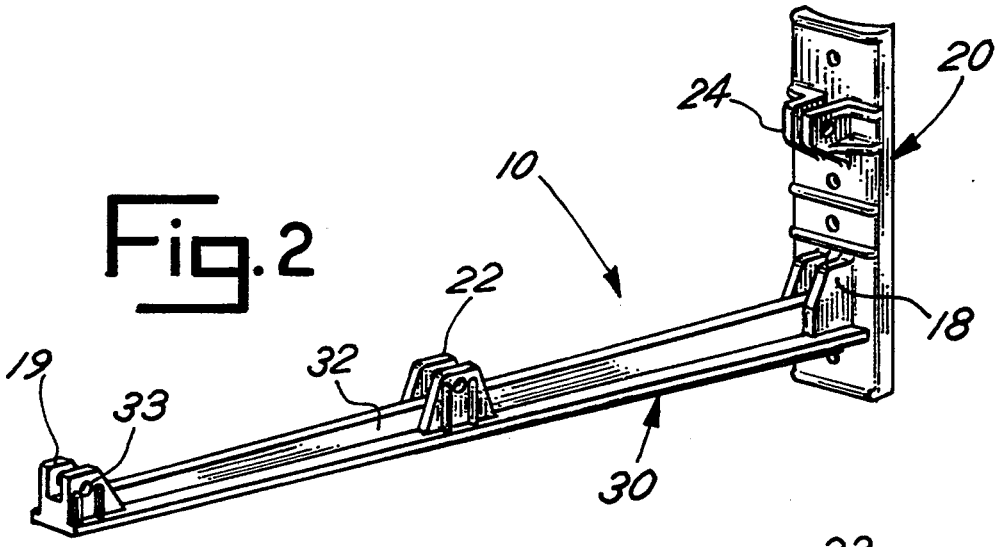
FIG. 2 is a perspective view of only the bracket.
Figure 3:
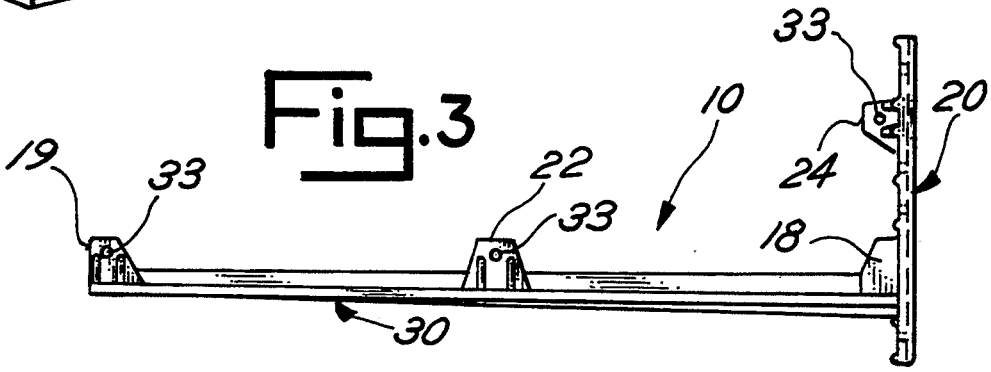
FIG. 3 is a side elevational view of the bracket of FIG. 2.
Figure 4:
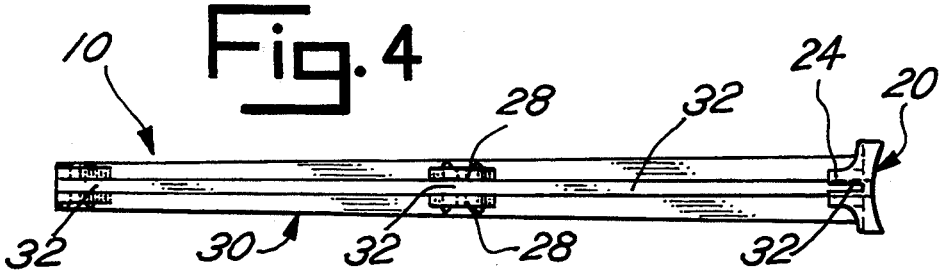
FIG. 4 is a top plan view of the bracket of FIG. 2.

As seen in FIGS. 2 and 3, bracket 10 is generally L-shaped and includes a vertical leg 20 and a horizontal foot 30. Foot 30 is joined at its proximate end to the lower end of leg 20. Leg 20 extends at a 90° angle to foot 30.

One retainer element 18 of bracket 10 is located at the proximate end of foot 30 where foot 30 joins leg 20. A second retainer element 19 is also located on foot 30 at the distal end of foot 30. A third retainer element 22 is located on foot 30 and positioned between retainer elements 18 and 19. The fourth retainer element 24 of bracket 10 is positioned on the upper end of leg 20 above retainer element 18. Each retainer element 18, 19, 22, and 24 is formed by a pair of spaced parallel tabs 28 which define a channel 32 between the tabs. Channels 32 lie in the same vertical plane. Each retainer element 19, 22, and 24 has aligned holes 33 extending through its pair of tabs 28.

Sign 12 is secured to bracket 10 by having its lower edge 9 and a side marginal edge 11 fitted restrictively into channels 32 of retainer elements 19, 22, and 24. Screws 36, or a similar pinlike fastener, extend through holes 33 in each retainer element and aligned holes in the marginal edges 9 and 11 of sign 12.

Retainer element 18 at the corner of the junction of bracket leg 20 and foot 30 serves to restrain and secure the lower inside corner of sign 12. This provides an improved anchor which in conjunction with the remaining retainer elements 19, 22, and 24 adequately secures the sign against wind driven elements.

It is understood that the above description does not limit the invention to the details given, but may be modified within the scope of the following claims.

We claim:

1. A bracket for attaching a sign to a substantially vertical support structure, said bracket comprising a unitary body member, said body member including a vertical leg and a horizontal foot, said leg and foot being joined together at a junction in a substantially right angular orientation, a plurality of retainer means carried by said leg and foot for engagement with said sign, said retainer means protruding forwardly from said leg and upwardly from said foot, a said retainer means protruding from each of said leg and foot, another said retainer means located at said junction between the leg and foot, each retainer means includes two spaced tab members defining a channel means therebetween for receiving a perimeter edge of said sign.

2. The bracket of claim 1 wherein said retainer means protruding from said foot is located at the opposite end of the foot from said junction between the leg and foot.

3. The bracket of claim 2 and still another said retainer means located between said last mentioned retainer means and said junction between the leg and foot.

* * * * *